US006718136B2

(12) United States Patent
Bird et al.

(10) Patent No.: US 6,718,136 B2
(45) **Date of Patent: *Apr. 6, 2004**

(54) FLEXIBLE FLASHLIGHT EXTENSION

(75) Inventors: Phillip Brandt Bird, Park City, UT (US); Albert Chen, Irvine, CA (US)

(73) Assignee: Mag Instrument, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/941,930

(22) Filed: Aug. 28, 2001

(65) Prior Publication Data

US 2002/0131269 A1 Sep. 19, 2002

(Under 37 CFR 1.47)

Related U.S. Application Data

(63) Continuation of application No. 09/374,336, filed on Aug. 13, 1999, now Pat. No. 6,280,050.

(51) Int. Cl.[7] ..... F21L 4/04

(52) U.S. Cl. ..... 396/198; 362/191; 362/199; 362/418

(58) Field of Search ..... 362/198, 191, 362/287, 418, 190

(56) References Cited

U.S. PATENT DOCUMENTS 6,280,050 B1 * 8/2001 Bird et al. ..... 362/191

* cited by examiner

*Primary Examiner*—Thomas M. Sember
*Assistant Examiner*—John Anthony Ward
(74) *Attorney, Agent, or Firm*—Clayton, Howarth & Cannon, P.C.

(57) ABSTRACT

A removable flexible extension to space apart a flashlight head and body of a commercially available flashlight, thereby adding a deformable flashlight extension that can be shaped to a desired configuration.

41 Claims, 2 Drawing Sheets

FLEXIBLE FLASHLIGHT EXTENSION

This application is a continuation of U.S. patent application Ser. No. 09/374,336, now U.S. Pat. No. 6,280,050. filed Aug. 13. 1999, entitled "FLEXIBLE FLASHLIGHT EXTENSION." which is hereby incorporated by reference herein in its entirety, including but not limited to those portions that specifically appear hereinafter.

BACKGROUND

1. The Field of the Invention

This invention relates to illumination devices and provides an improved flexible extension for such devices. More particularly, this invention provides a flexible spacer which may be incorporated between the bulb casing, or head, and the battery casing, or body, of a flashlight.

2. The Background Art

At times it is desirable to extend a flashlight head (carrying the attendant light source) from a flashlight body. For example, an extension of this kind facilitates the inspection of components in an airplane. Similarly, appropriately configured such extensions are useful to inspect components in any crowded, cramped or partially obstructed environment. In such cases, it is particularly advantageous to be able to direct the illumination from a flashlight, by way of bending a flexible portion of the flashlight, to fit around obstructions without significantly limiting the field of view of an inspector. It may also be advantageous to be able to adapt a flexible member to interface with a support structure simply to aim a flashlight beam without requiring hands-on operation of the flashlight.

Flexible extensions which function to space apart a flashlight head (having a light source) and a flashlight body (carrying an energy source), are known, but all known devices present one or more disadvantages. One commercially available flashlight extension is sold by Aircraft Flashlights Inc. as a "Flexible Shaft Flashlight." The Flexible Shaft Flashlight product includes a flexible member which may be removed to convert the product to a regular flashlight. One example of the Flexible Shaft Flashlight extension has a shiny metal conduit flexing member containing an insulated electrically conducting wire. The conduit is a continuous helical or spiral wrapped piece of metal configured to form a hollow cylinder, wherein each wrap partially overlaps a prior wrap. The substrate metal forming such a conduit is chrome plated, thereby to create a shiny surface. Another example of the Flexible Shaft Flashlight has a substantially glare-free, black-colored, heat-shrink tubing installed over a metal conduit flexing member, which also contains an insulated electrically conducting wire.

Such prior offerings are unnecessarily expensive and have other drawbacks. A substantial amount of manufacturing effort is required to form a flexible conduit member. Additional manufacturing effort is required to insert an electrically conductive, insulated wire into the conduit. The conduit flexing member may loose desirable flexing characteristics with use as the conduit member relaxes, and overlapping wraps no longer help to hold a conduit in a deformed shape. Moreover, internal components may break (including the small-diameter conductive wire) after repeated flexing. Furthermore, extra manufacturing effort is required to add an external protective and/or decorative coating to either electrically insulate the conduit member or to prevent glare from a shiny surface. Added structure, such as an external heat-shrink tubing, may reduce desirable plastic, or deformed-shape maintaining properties by disadvantageously increasing the restorative force tending to form a straight extension member. Such restorative force, or memory, limits the angle which can be maintained by a flexible member subsequent to undergoing a bending displacement.

In view of the above mentioned disadvantages, it would be an advance in the industry to provide a device for flexibly extending a flashlight head from a flashlight body which overcomes these and other drawbacks.

BRIEF SUMMARY AND OBJECTS OF THE INVENTION

In view of the above described state of the art, the present invention seeks to realize the following objects and advantages.

It is a primary object of the present invention to provide a flexible flashlight extension which is efficient and easy to use.

It is also an object of the present invention to provide a flexible flashlight extension which can be readily manufactured at a low cost.

It is a further object of the present invention to provide a flexible flashlight extension that has improved properties to hold sharper bend angles subsequent to a given bending displacement.

It is a further object of the present invention to provide a flexible flashlight extension which can be easily positioned.

These and other objects and advantages of the invention will become more fully apparent from the description and claims which follow, or may be learned by the practice of the invention.

The present invention is directed to portable devices having flexible portions to provide directable illumination to areas including cramped, awkward, or partially obstructed areas. Most particularly, the invention provides a removable flexible extension to space apart a flashlight head and body of a commercially available flashlight, thereby creating a deformable extension that can be shaped to a desired configuration.

A typical flashlight extension is flexible, and has a body having first and second end fittings separated by a length distance. The body generally includes an electrically conductive core having a memory to elastically deform under small bending displacements, and plastic material properties to substantially hold a deformed shape subsequent to large bending displacements. The body also generally includes a second member, forming a substantially nonconductive and cylindrical barrier disposed generally concentrically with the first member. The body also preferably includes a third member, forming a conductive element electrically isolated from the first member, and being spaced radially from the first member by the second member, and further being disposed approximately concentrically with respect to the second member. The body may also include a fourth member, disposed radially about the third member, and forming a protective covering for substantially the entire length of the third member. Typically, the first, second, third, and fourth members are approximately concentrically arranged. The second, third, and fourth members typically have material properties and cross-sectional dimensions in combination such that deformations of the body are substantially governed by deformations of the first member.

A first end fitting is typically affixed to a first end of the body, and is generally configured and arranged to interface in a removable and electrically conductive relation with an end of a flashlight subsequent to the removal of a head of the flashlight from the end of the flashlight. A second end fitting is generally affixed to a second end of the body, and is usually configured and arranged to interface in a removable and electrically conductive relation with the flashlight head. In general, the first body member comprises the primary load carrying member of the body. Representative bodies have a preferable outside diameter between about 0.1 inch and 0.5 inch, and a preferable length between about 1 inch and 36 inches. However, both larger and smaller body diameters, as well as longer body lengths, are workable and are within the scope of the present invention.

One example of the present invention is formed from four concentric members, wherein the first member includes a solid metal, typically copper wire, the second member includes plastic-type materials, the third member includes a plurality of metal wires, and the fourth member includes plastic-type materials. An exemplary body includes cable sold commercially under the designation RG-11 type coaxial cable. Different embodiments of the present invention may be used in combination with an assortment of commercially available flashlights.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
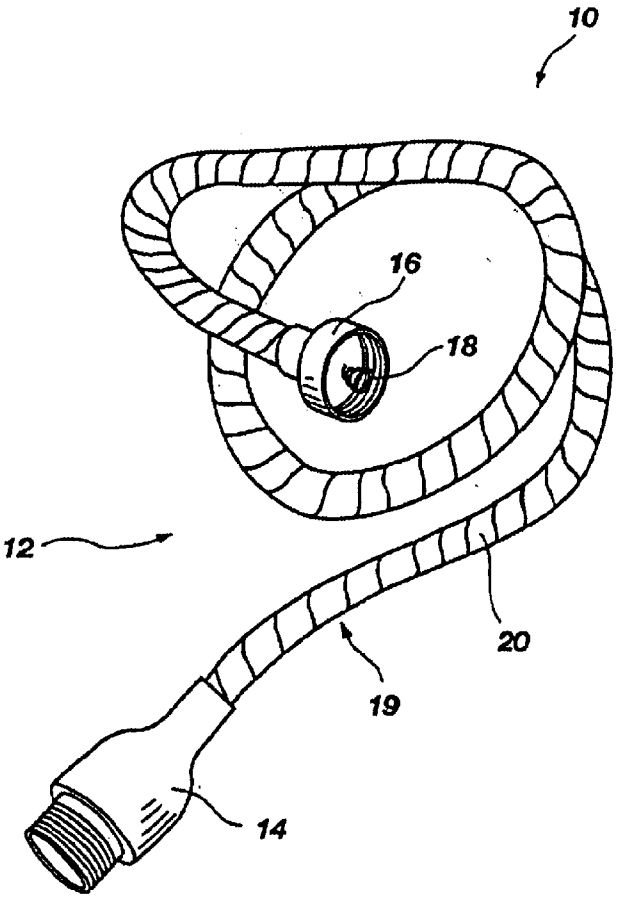
FIG. 1 is a perspective view of a first prior art flexible extension.

Reference will first be made to FIG. 1 which is a perspective view of a first commercially available flexible flashlight extension member, generally designated at 10. The extension member 10 has a body, generally designated at 12, between first and second end fittings 14 and 16, respectively. End fittings 14 and 16 are constructed and arranged to interface with a commercially available flashlight. End fitting 14 removably replaces a flashlight head in the flashlight to be extended. End fitting 16 removably receives the flashlight head. Visible in the illustration in end fitting 16 is a spring element 18. Spring element 18 is electrically isolated from end fitting 16, and in combination with at least a conductive element (not shown) disposed inside body 12, provides one of the two electrically conductive paths required to energize a flashlight lamp positioned in the flashlight head (not shown). Body 12, being typical of the commercially available devices, includes a conduit 19 formed of a conductive material, and in combination with end fittings 14 and 16, provides the second electrically conductive path to energize a lamp. Conductive conduit material is arranged as a continuous, overlapping, spirally-wound metal ribbon 20. Conduit 19 forms the primary structure which holds a deformed shape in the body 12 subsequent to bending displacements. Disadvantageously, conduit 19 is subject to wear from extended use, and may lose the ability to hold a deformed shape.

Figure 2:
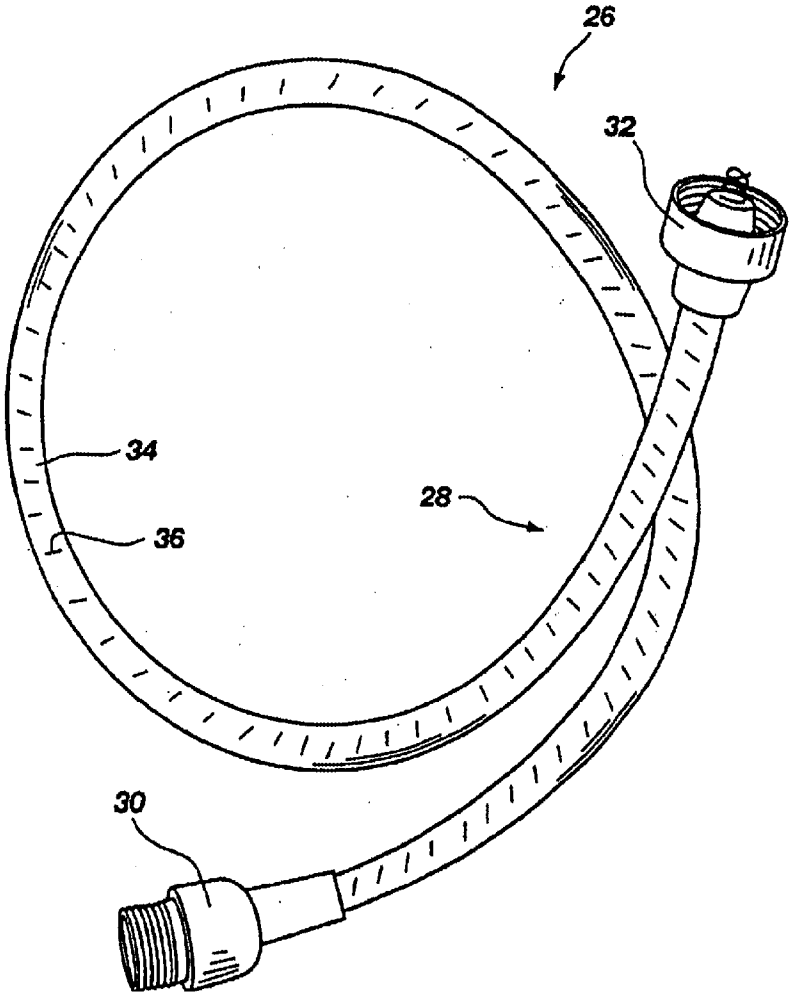
FIG. 2 is a perspective view of a second prior art flexible extension.

A second commercially available flashlight extension is illustrated in FIG. 2, and generally indicated at 26. A second arrangement for a body 28 is disposed between first and second end fittings 30 and 32, respectively. Body 28 has a heat-shrink tubing 34 forming a protective skin over an internal conduit (not shown). However, the presence of the conduit is indicated by surface marks 36 visible on heat-shrink tubing 34.

Heat-shrink tubing 34, as illustrated in the device of FIG. 2, provides a flashlight extension with a desirable exterior surface. Desirable properties include a generally glare-free, nonshiny appearance, and a good tactile "feel." Friction from a yielding surface, such as provided by the tubing, helps prevent sliding of a flashlight extension when placed upon a sloping surface. The tubing further provides a measure of scratch protection from a flashlight extension, and insulates the body portion from electrical contact with the surrounding environment. However, certain drawbacks are inherent to the flashlight extension 26 having a heat-shrink tubing 34. For example, a comparison of the devices of FIGS. 1 and 2 illustrate the reduced ability of flashlight extension 26 to hold a bend displacement which has been manually imposed upon the devices. The devices 10 and 26 of FIGS. 1 and 2 represent the resulting coiled configurations of the respective flashlight extensions 10 and 26 subsequent to receiving manually imposed, equivalent bending displacements. While both devices 10 and 26 have relaxed to a degree from the initial coil displacement, it is seen that device 26 has relaxed to a much more significant degree. In other words, device 26 cannot hold as sharp a bend angle subsequent to a given bending displacement. This reduced bend holding capability is due to the interaction of the heat-shrink tubing 34 and the conduit 19. Again, the conduit is subject to wear from extended use, and will likely lose its limited ability to hold a deformed shape even sooner, compared to the device 10 represented in FIG. 1.

Figure 3:
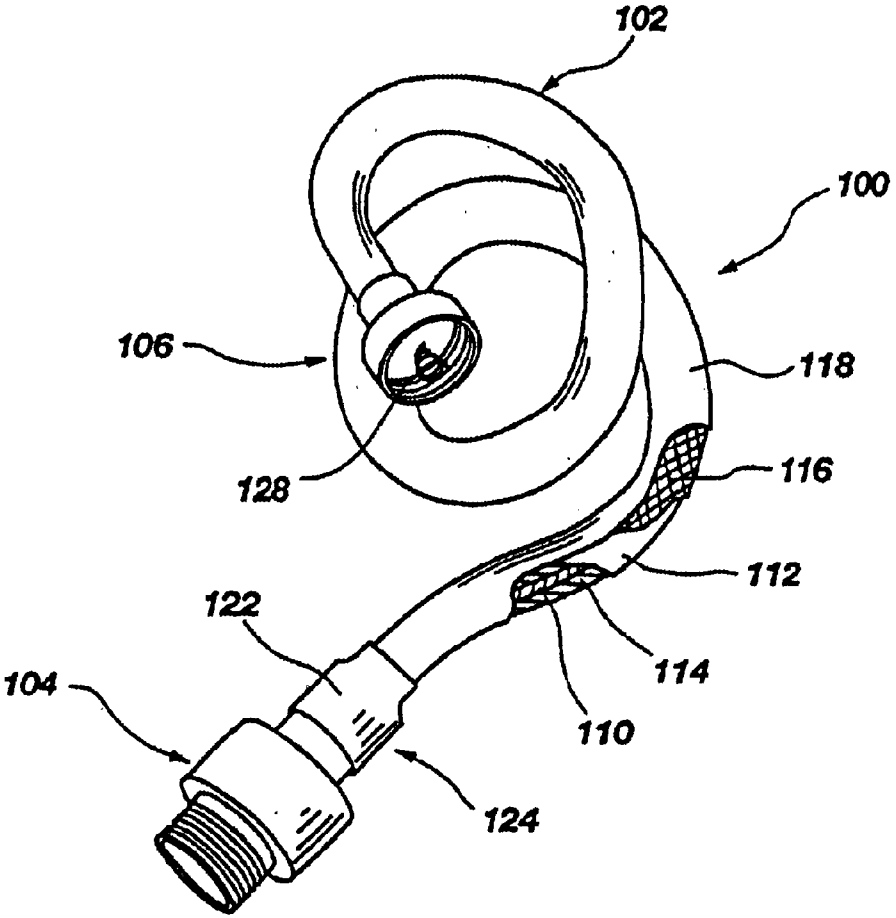
FIG. 3 is a perspective view, partially in section, of a first flexible extension according to principles of the present invention.

FIG. 3 illustrates a flexible flashlight extension member, indicated generally at 100, constructed according to principles of the present invention. As will soon be appreciated, the preferred embodiments of the present invention provide advantages not obtainable with the described commercially available devices. A flexible body 102 is disposed between first and second end fittings 104 and 106, respectively. The flexible body 102 typically has a first member 110, which forms an electrically conductive core and has a memory to elastically deform under small bending displacements, and plastic properties to substantially hold a deformed shape subsequent to large bending displacements. Such a conductive core element may be a solid cylindrical member, a metal plated solid metal cylinder, solid copper wire, copper plated steel wire, tinned copper wire, or wire wrapped solid wire. Solid copper wire is used in certain preferred embodiments of the present invention.

With further reference to FIG. 3, a second member 112 of body 102 forms a substantially nonconductive and cylindrical barrier about the conductive core, and is disposed generally concentrically with the first member 110. Second member 112 is depicted in cross-section at 114 in the illustration of FIG. 3. An exemplary second member 112 is typically formed from plastic, or plastic-type materials such as: polyethylene, cellular (foam) polyethylene, foam polyethylene dielectric, polyvinylchloride (PVC), flourinated ethylene-propylene (FEP), foam FEP, FEP Teflon, and cellular FEP Teflon.

Continuing to refer to FIG. 3, a third member 116, forms a second conductive element of body 102, and is electrically isolated from the first member 110. Third member 116 is spaced radially from the first member 110 by the second member 112. Second member 112 electrically isolates member 110 from third member 116. Third member 116 is further disposed approximately cylindrically about the second member 112. An exemplary third member 116 of body 102 generally includes one or more of: at least one wire having a diameter equal to or smaller than the first member's diameter, a plurality of wires having diameters smaller than the first member's and that are braided or wrapped about second member 112, metalized tape, aluminum/Mylar film, conductive foil, Al/polyester or Al/polyester/Al tape foil or film, aluminum or stainless steel wires having small diameters, copper braid, or tinned copper braid. A preferred embodiment of third member 116 includes a plurality of small diameter wires spaced around the circumference of the second member 112.

A fourth member 118 of body 102, as illustrated in FIG. 3, is disposed radially about third member 116, and forms a protective covering for substantially the entire length of the third member 116. Certain end portions of body 102 may have a length of third member 116 exposed, or not covered by member 118, for the purpose of forming an electrical connection with an end fitting. An exemplary fourth member 118 of body 102 may be made from rubber materials or plastic-like materials. One preferred embodiment of member 118 is a polyvinylchloride (PVC) jacket. The outside diameter of fourth body member 118 is typically between about 0.1 inch and 0.5 inch. One preferred diameter is about 0.4 inch.

The conductive core element of a flexible flashlight extension according to this invention forms the primary "plastic" structure which holds a deformed shape. "Plastic" for purposes of this disclosure means the tendency of a material to remain in a displaced configuration subsequent to a displacement from an initial configuration. A core element may be considered as having a dual elastic/plastic nature. Small bending displacements do not result in plastic deformation of a body, as the flexible body has a memory to restore the body to substantially the same position as prior to the small displacement. Large bending displacements of a body according to the present invention do result in residual deformation of the body. The first member of a flexible flashlight extension body, or conductive core element, is plastically deformed by a large bending displacement, and prefers to remain substantially in the deformed shape. The third member generally has a secondary "plastic" response to large bending displacements which contributes to a flashlight extension holding a bent shape, but to a lesser degree than the first member. The second and fourth members may also exhibit some plastic behavior, but are more inclined to return to an approximately straight configuration, regardless of the magnitude of the bending displacement.

From an understanding of the forgoing, it will be appreciated that the first member and the second member impart important characteristics to the described embodiments of the present invention. Many structures other than those described herein can carry out the functions of the third and fourth members. For example, a separate conductive path can be embedded in the second member to provide a complete electrical circuit to and from the flashlight lamp. Such modifications can be carried out by those skilled in the art in accordance with the present invention using the information set forth herein.

As known in the industry, transverse bending of a member is governed by a section modulus, EI. The section modulus is a combination of material properties including Young's Modulus, E, and the Moment of Inertia, I, of the cross-section. A desirable flashlight extension according to the present invention includes a first and third member having a section modulus in combination that is greater than the section modulus of the remaining flexible body cross-section. A more desirable flashlight extension according to the present invention includes a first member, or core element, having a section modulus greater than the section modulus of the remaining body cross-section. A most desirable flashlight extension according to the present invention includes a core element having a section modulus significantly greater than the section modulus of the remaining body cross-section.

Interaction of the materials forming a body help to prevent premature failure due to overbending of the body. Second, third, and fourth members occupy a volume which defines a minimum radius achievable by a deformed body. In the preferred embodiments, the second member defines the minimum bend radius for the first member. Also in the preferred embodiments, the second, third and fourth members must all fit into the minimum bend radius, and thereby space the first member from the center of curvature by at least their combined thicknesses. The actual spacing will be more than the combined thicknesses due to the incompressibility of the individual materials. By helping to maintain a safe radius of curvature, the second, third and fourth members cooperate to help prevent premature fatigue and bending failure of the first member.

FIG. 3 also illustrates heat-shrink tubing 122, which is preferably installed at a connection portion, generally indicated at 124, of end fitting 104. Tubing 122 may be included to provide a cosmetically desirable appearance, or to provide a fluid resistant barrier to the connection. In the illustration of FIG. 3, connection portion 124 includes a crimped-on connection to a first end of body 102. End fittings may be affixed to end portions of body 102 by crimping, soldering, adhesive material, or any other appropriate manufacturing method. A first end fitting is generally configured and arranged to interface in a removable and electrically conductive relation with an end of a flashlight subsequent to the removal of a head of the flashlight from its end. A second end fitting is generally configured and arranged to interface in a removable and electrically conductive relation with the flashlight head. The end fittings may be configured to fit with any number of different types of flashlights, both those now available and those which become available in the future. Those skilled in the art can arrive at the most desirable configuration for an end fitting in view of the particular application for the present invention. It is also within the scope of the present invention to have one or both end fittings to form a rotary type switch which operates to turn on and off a flashlight lamp.

The invention is suitable for use in combination with a commercially available flashlight. End fittings may be provided to fit commercially available flashlights using various batteries including sizes: AAA, AA, C, D, (among others), and operating between about 1 and about 12 volts. The present invention is not restricted to such listed parameters, but the listing merely acknowledges typical characteristics of portable light sources, including flashlights, which can be used with the present invention.

An exemplary body may be formed from coaxial cable such as coaxial cable used for LAN cables, CATV cables (preferred), broadcast and computer cables, VHF-UHF cables, video cables, MATV cables, and audio/video cables. An preferred cable is commercially available and is designated as RG-11 type coaxial cable having a solid copper core. The exemplary RG-11 cable has a 14 gage solid copper core and a total outside diameter of 0.405 inches. Other types of coaxial cables may find application as flashlight extension bodies within the scope of the present invention. However, it has been determined that RG-59, RG-58, and even RG-6, all with solid cores, possess less than optimum plastic response to bending displacements. These latter cables have 18 or 20 gage copper wire cores which possess an undesirable section modulus for a most preferred core element. These cables have certain desirable properties, such as small outside diameters, desirable inherent color, scuff resistance, and good tactile feel, but require either core elements with larger diameters or stiffer cores having higher moduli of elasticity, or both, to gain the desired section modulus which is most preferred.

Useful body lengths for a flexible flashlight extension are in the range from about 1 inch to about 36 inches, although longer lengths may be useful in certain applications. Flexible flashlight bodies are preferably in the range from about 4 inches to about 20 inches. Most preferable lengths for a flexible flashlight extension are in the range from about 8 inches to about 20 inches. One most preferred length is about 16 inches.

Figure 4:
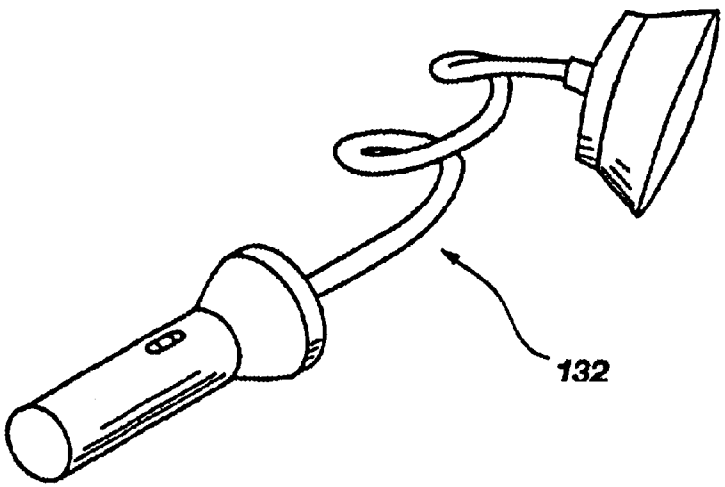
FIG. 4 is a perspective view of a second flexible extension according to principles of the present invention, and shown in combination with a flashlight.

The illustrated embodiment of FIG. 3, and prior art devices represented in FIGS. 1 and 2, are sized to fit flashlights using batteries of AA size. The core element of the preferred embodiments provides improved weight carrying capabilities of a flexible body to allow support of increased size of flashlight heads. From an understanding of the foregoing, it will be understood that the core element is the primary load carrying element of a flexible flashlight extension in the presently preferred embodiments of the present invention. The improved weight carrying capabilities of an embodiment, generally designated at 132 in FIG. 4, allows the invention to be used with larger sized flashlights and larger sized flashlight heads. It will be appreciated that, depending upon the particular weight carrying requirements of a flashlight, the structure of an embodiment of the present invention may vary from the preferred embodiments set forth herein and still fall within the scope of the present invention.

In view of the forgoing, it will be appreciated that the present invention provides a flexible flashlight extension for extending a flashlight head a distance from a flashlight body which is efficient and easy to use. It is also seen by the foregoing that the present invention provides a flexible flashlight extension which can be easily manufactured at a low cost by using commercially available materials. Furthermore, the present invention provides a flexible flashlight extension that has improved properties to hold sharper bend angles subsequent to a given bending displacement. The present invention also provides a flexible flashlight extension which can be easily positioned by the user for greatest convenience during use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A flashlight extension that is flexible, comprising:

a body having first and second end fittings separated by a length distance, said body comprising;

a first member, forming an electrically conductive core;

a second member, forming a substantially nonconductive barrier disposed generally concentrically with said first member;

a third member, forming a conductive element, and being electrically isolated from said first member, and further being disposed approximately concentrically with respect to said second member;

a fourth member, disposed radially about said third member, and forming a protective covering for substantially the entire length of said third member;

said second, third, and fourth members having material properties and cross-sectional dimensions in combination such that deformations of said body are substantially governed by deformations of said first member; with said first end fitting being affixed to a first end of said body, said first end fitting further being configured and arranged to interface in a removable and electrically conductive relation with an end of a flashlight; and said second end fitting being affixed to a second end of said body, said second end fitting further being configured and arranged to interface in a removable and electrically conductive relation with a flashlight head.

2. An apparatus according to claim 1, wherein said first member comprises the primary load carrying member of the body.

3. An apparatus according to claim 2, wherein said body has an outside diameter in the range from about 0.1 inch to about 0.5 inch.

4. An apparatus according to claim 3, wherein said body has a length in the range from about 1 inch to about 36 inches.

5. An apparatus according to claim 4, wherein said first, second, third, and fourth members are substantially concentrically arranged.

6. An apparatus according to claim 5, wherein said first member comprises a solid metal wire.

7. An apparatus according to claim 5, wherein said first member comprises solid copper wire.

8. An apparatus according to claim 6, wherein said second member comprises plastic-type materials.

9. An apparatus according to claim 8, wherein said third member comprises a plurality of metal wires.

10. An apparatus according to claim 9, wherein said fourth member comprises plastic-type materials.

11. An apparatus according to claim 10, wherein said body comprises RG-11 coaxial cable.

12. An apparatus according to claim 10, further in combination with a flashlight.

13. A flashlight extension that is flexible, comprising:

a body having a length between first and second end fittings, said body comprising;

a first member, forming an electrically conductive core having a first section modulus;

a second member, forming a substantially nonconductive barrier disposed generally concentrically with said first member, said second member having a second section modulus;

a third member, forming a conductive element spaced apart radially from said first member by said second member, said third member having a third section modulus;

a fourth member forming a protective covering for substantially the entire length of said third member, said fourth member having a fourth section modulus;

said second, third, and fourth members having section moduli in combination such that deformations of said body are substantially governed by deformations of said first member; with said first end fitting being affixed to a first end of said body, said first end fitting further being configured and arranged to interface in a removable and electrically conductive relation with an end of a flashlight; and said second end fitting being affixed to a second end of said body, said second end fitting further being configured and arranged to interface in a removable and electrically conductive relation with a flashlight head.

14. An apparatus according to claim 13, wherein said first member comprises the primary load carrying member of the body.

15. An apparatus according to claim 14, wherein said body has an outside diameter in the range from about 0.1 inch to about 0.5 inch.

16. An apparatus according to claim 15, wherein said body has a length in the range from about 1 inch to about 36 inches.

17. An apparatus according to claim 16, wherein said first, second, third, and fourth members are approximately concentrically arranged.

18. An apparatus according to claim 17, wherein said body comprises RG-11 coaxial cable.

19. An apparatus according to claim 18, further in combination with a flashlight.

20. A flexible flashlight extension comprising:

a body having first and second end fittings separated by a length distance, said body comprising;

a first member, forming an electrically conductive core;

a second member, forming a substantially nonconductive barrier disposed generally concentrically with said first member;

a current carrying path from the first end fitting to the second end fitting;

said second member having material properties and a cross-sectional dimension such that deformations of said body are substantially governed by deformations of said first member; with said first end fitting being affixed to a first end of said body, said first end fitting further being configured and arranged to interface in a removable and electrically conductive relation with an end of a flashlight; and said second end fitting being affixed to a second end of said body, said second end fitting further being configured and arranged to interface in a removable and electrically conductive relation with a flashlight head.

21. An apparatus according to claim 1, wherein said first member comprises the primary load carrying member of the body.

22. An apparatus according to claim 20, wherein said current carrying path comprises a third member, forming a conductive element, and being electrically isolated from said first member, and being spaced radially from said first member by said second member, and further being disposed approximately concentrically with respect to said second member, the third member comprising a plurality of metal wires.

23. An apparatus according to claim 22, further comprising a fourth member disposed radially about said third member, and forming a protective covering for substantially the entire length of said third member, the fourth member comprising plastic-type materials.

24. An apparatus according to claim 20, wherein said body has an outside diameter in the range from about 0.1 inch to about 0.5 inch.

25. An apparatus according to claim 24, wherein said body has a length in the range from about 1 inch to about 36 inches.

26. An apparatus according to claim 23, wherein said first, second, third, and fourth members are substantially concentrically arranged.

27. An apparatus according to claim 20, wherein said first member comprises a solid metal wire.

28. An apparatus according to claim 20, wherein said first member comprises solid copper wire.

29. An apparatus according to claim 20, wherein said second member comprises plastic-type materials.

30. A flexible flashlight extension comprising:

a first end fitting configured and arranged to interface in a removable and electrically conductive relation with an end of a flashlight;

a second end fitting configured and arranged to interface in a removable and electrically conductive relation with a flashlight head;

a body connected to said first end fitting and said second end fitting, said body comprising:

a first member forming a core, said core having properties to hold said body in a deformed shape subsequent to bending displacements;

a second member disposed generally concentrically with said first member; and a protective covering disposed generally concentrically with said first member and said second member, said protective covering providing a smooth surface characterized by an absence of ridges and joints.

31. The flexible flashlight extension of claim 30, further comprising a current carrying path from the first end fitting to the second end fitting.

32. The flexible flashlight extension of claim 30, further comprising a third member forming a conductive element, said third member being electrically isolated from said first member, and being spaced radially from said first member by said second member.

33. The flexible flashlight extension of claim 32, wherein said third member comprises a plurality of metal wires.

34. The flexible flashlight extension of claim 30, wherein said protective covering is comprised of plastic-type materials.

35. The flexible flashlight extension of claim 30, wherein said first member comprises a solid metal wire configured to be the primary load carrying member of the body.

36. The flexible flashlight extension of claim 30, wherein said first member has a section modulus that is greater than a section modulus of said of said protective covering.

37. A flexible flashlight extension comprising:

a first end fitting configured and arranged to interface in a removable and electrically conductive relation with an end of a flashlight;

a second end fitting configured and arranged to interface in a removable and electrically conductive relation with a flashlight head;

a body connected to said first end fitting and said second end fitting, said body comprising:

means for holding said body in a deformed shape subsequent to a bending displacement such that said body can be held in a sharp angle;

means for forming a non-conductive barrier about the means for holding the body;

means for conducting electricity from the first end fitting to the second end fitting; and means for covering said means for holding, said means for forming a non-conductive barrier, and said means for conducting electricity.

38. The flexible flashlight extension of claim 37, wherein said means for holding said body in a deformed shape comprises a solid metal wire.

39. The flexible flashlight extension of claim 37, wherein the means for forming a non-conductive barrier comprises a cylindrical barrier disposed generally concentrically with said means for holding.

40. The flexible flashlight extension of claim 37, wherein the means for conducting electricity comprises a conductive element formed of a plurality of metal wires disposed approximately concentrically with respect to said means for forming a non-conductive barrier.

41. The flexible flashlight extension of claim 37, wherein the means for covering comprises a smooth protective covering characterized by an absence of ridges and joints, said means for covering being disposed radially about said means for conducting electricity.

* * * * *